US008009848B2

(12) United States Patent
Roeck et al.

(10) Patent No.: US 8,009,848 B2
(45) Date of Patent: Aug. 30, 2011

(54) HEARING DEVICE SYSTEM, HEARING DEVICE MAINTENANCE SYSTEM, AND METHOD FOR MAINTAINING A HEARING DEVICE SYSTEM

(75) Inventors: Hans-Ueli Roeck, Hombrechtikon (CH); Ivo Hasler, Winterthur (CH); Philip Schneider, Zurich (CH); Stefan Launer, Zurich (CH)

(73) Assignee: Phonak AG, Stafa (CH)

( * ) Notice: Subject to any disclaimer, the term of this patent is extended or adjusted under 35 U.S.C. 154(b) by 1029 days.

(21) Appl. No.: 11/269,335

(22) Filed: Nov. 8, 2005

(65) Prior Publication Data

US 2007/0036280 A1 Feb. 15, 2007

Related U.S. Application Data

(63) Continuation-in-part of application No. 11/168,704, filed on Jun. 28, 2005.

(30) Foreign Application Priority Data

Jun. 27, 2005 (EP) ..... 05013793

(51) Int. Cl.
*H04R 25/00* (2006.01)
*H04R 29/00* (2006.01)

(52) U.S. Cl. ..... 381/312; 381/315; 381/60

(58) Field of Classification Search ..... 381/312
See application file for complete search history.

(56) References Cited

U.S. PATENT DOCUMENTS

| | | | | |
|---|---|---|---|---|
| 5,966,639 | A | 10/1999 | Goldberg et al. | |
| 7,039,195 | B1 * | 5/2006 | Svean et al. | 381/71.6 |
| 2002/0054689 | A1 * | 5/2002 | Zhang et al. | 381/312 |
| 2002/0196955 | A1 | 12/2002 | Boesen et al. | |
| 2003/0064746 | A1 * | 4/2003 | Rader et al. | 455/550 |
| 2005/0069161 | A1 | 3/2005 | Kaltenbach et al. | |
| 2005/0129262 | A1 * | 6/2005 | Dillon et al. | 381/312 |

FOREIGN PATENT DOCUMENTS

| | | | |
|---|---|---|---|
| DE | 100 30 915 | A1 | 1/2002 |
| EP | 1 256 260 | B1 | 7/2003 |
| EP | 1 414 271 | A2 | 4/2004 |
| EP | 1 473 969 | A2 | 11/2004 |

(Continued)

OTHER PUBLICATIONS

International Search Report, PCT/EP2006/063540, Oct. 30, 2006.

(Continued)

*Primary Examiner* — Curtis Kuntz
*Assistant Examiner* — Sunita Joshi
(74) *Attorney, Agent, or Firm* — Pearne & Gordon LLP

(57) ABSTRACT

The hearing device system having at least one hearing device includes an input transducer for receiving incoming acoustical sound and converting the incoming acoustical sound into audio-representing signals; an output transducer for converting audio-representing signals obtained from the incoming acoustical sound into signals to be perceived by a user of the hearing device; and a transmitter for transmitting audio-representing signals obtained from the incoming acoustical sound to a long-range communication network. The method for maintaining a hearing device system includes the steps of receiving in the hearing device an incoming acoustical sound; converting in the hearing device the incoming acoustical sound into audio-representing signals; and transmitting the audio-representing signals from the hearing device to a long-range communication network. The audio-representing signals may be received by a hearing device support provider.

21 Claims, 3 Drawing Sheets

FOREIGN PATENT DOCUMENTS

| | | | | |
|---|---|---|---|---|
| EP | 1 530 403 | A1 | | 5/2005 |
| JP | 2004274677 | A | | 9/2004 |
| WO | 01/54458 | A2 | | 7/2001 |
| WO | 0154458 | A2 | | 7/2001 |
| WO | WO 0154458 | A2 | * | 7/2001 |
| WO | 2004/110099 | A2 | | 12/2004 |
| WO | 2004110099 | A2 | | 12/2004 |
| WO | WO 2004110099 | A2 | * | 12/2004 |
| WO | 2005004534 | A1 | | 1/2005 |

OTHER PUBLICATIONS

Patent Abstracts of Japan, vol. 2003, No. 12, Dec. 5, 2003—& JP 2004 274677 A (Osaka Industrial Promotion Organization; First Electronics Development), Sep. 30, 2004, the whole document.

* cited by examiner

HEARING DEVICE SYSTEM, HEARING DEVICE MAINTENANCE SYSTEM, AND METHOD FOR MAINTAINING A HEARING DEVICE SYSTEM

TECHNICAL FIELD

The invention relates to a hearing device system comprising at least one hearing device and to a system and a method for maintaining—and in particular fitting—a hearing device and a hearing device system, respectively. The hearing device can be a hearing aid, which is in full or in part worn in or near the ear or implanted, a headphone, an earphone, a hearing protection device, a communication device or the like.

BACKGROUND OF THE INVENTION

Hearing devices, e.g., hearing aids, need, like other devices, some maintenance. E.g., when the user of the hearing device realizes that a problem or failure of the hearing device occurred, or when the user is dissatisfied with the hearing device's performance, he usually will sooner or later contact his audiologist or the hearing device seller and arrange a meeting, at which the two meet.

From WO 01/54458 A2 hearing systems and corresponding methods are known, which involve mobile communication devices in fitting, programming or upgrading said hearing systems.

From EP 1 256 260 B1 a fitting system is known, which involves a mobile phone in a fitting process of said hearing system.

It is desirable to provide for an enhanced support for hearing devices and hearing device users.

SUMMARY OF THE INVENTION

Therefore, a goal of the invention is to create a hearing device system comprising at least one hearing device and a system and a method for maintaining a hearing device and a hearing device system, respectively, which provide for an enhanced support and/or enhanced maintenance possibilites.

An object of the invention is to provide for enhanced remote maintenance and support possibilities.

Another object of the invention is to provide for enhanced fitting possibilities, i.e. enhanced possibilities to adapt the hearing device or a hearing device system to the needs and preferences of a user of said hearing device.

These objects are achieved by systems and by methods according to the patent claims.

The hearing device system comprises

- an input transducer for receiving incoming acoustical sound and converting said incoming acoustical sound into audio-representing signals;
- an output transducer for converting audio-representing signals obtained from said incoming acoustical sound into signals to be perceived by a user of the hearing device; and
- a transmitter for transmitting audio-representing signals obtained from said incoming acoustical sound to a long-range communication network.

The last item can also be read as the hearing device system comprising a transmitter for transmitting audio-representing signals obtained from said incoming acoustical sound via a long-range communication connection.

Hence, it is possible to receive said audio-representing signals obtained from said incoming acoustical sound at a place located remote from the hearing device. A hearing device support provider can use a suitable receiver to receive said audio-representing signals from (or via) said long-range communication network.

Said input transducer can, e.g., be a microphone. Said output transducer can, e.g., be a loudspeaker or an implanted hearing device part for generation of signals perceivable by the user. Said transmitter can, e.g., be a RF transmitter.

Said transmission of said audio-representing signals obtained from said incoming acoustical sound to said long-range communication network can take place directly from the hearing device worn at or near the user's ear to said long-range communication network, or via a communication device, which is part of the hearing device system but not to be worn near or at an ear, e.g., a mobile phone. For example, the hearing device is fully worn near the user's ear or ears and communicates with the user's mobile phone via a short-range communication network like Bluetooth, and said mobile phone again communicates via said long-range communication network.

A long-range communication connection exists between the hearing device system's transmitter and said network.

Said long-range communication network as well as said short-range communication network may be wireless or wire-bound networks. E.g., they may involve mobile phones and/or stationary telephones. Communication connections used for said transmission may include wireless and/or wire-bound connections.

Said long-range connection as well as the short-range connection may be a bidirectional connection, in which case audio-representing signals and/or other data may not only be transmitted from the hearing device system to the network (and usually further to a hearing device support provider), but also in the reverse direction.

Usually, the hearing device system comprises besides said input transducer, said output transducer and said transmitter a signal processor for processing audio-representing signals. Said signal processor can be considered a converter for generating processed audio-representing signals.

Said audio-representing signals are electrical signals (analog and/or digital), which are obtained from acoustical sound (sound waves) through conversion and possibly further processing, like filtering, amplifying, compressing.

Said transmitter is usually adapted to transmitting said audio-representing signals obtained from said incoming acoustical sound to a long-range communication network for further transmission to a hearing device support provider.

Said hearing device support provider may be or comprise an individual. Said individual can be a person associated with a manufacturer of said hearing device, e.g., a person of the support or trouble-shooting department of the hearing device manufacturer. In another embodiment, said individual is associated with a hearing device seller. The person may be a hearing device fitter. The individual may be a hearing device specialist, an audiologoist or another person trained or knowledgeable in the respective hearing devices.

In another embodiment, said hearing device support provider is or comprises a computer with a support software. That computer may be located and/or owned and/or maintained by the hearing device manufacturer or by the hearing device seller or another above-mentioned individual.

Said hearing device support provider usually is located remote from the hearing device and the hearing device user.

In a typical embodiment, the hearing device is operatable in a normal operation mode, in which

- said incoming acoustical sound is received by said input transducer and converted into said audio-representing signals;

said audio-representing signals obtained from said incoming acoustical sound are processed in said signal processor, thus generating processed audio-representing signals; and said processed audio-representing signals are converted in said output transducer into said signals to be perceived by said user of the hearing device.

In the normal operation mode, no transmission by said transmitter of said audio-representing signals obtained from said incoming acoustical sound to a long-range communication network takes place.

In the normal operation mode, one major task of the hearing device is to provide the user with a signal (=signal to be perceived by the user), which is obtained from the acoustical environment currently surrounding the user. To provide the user with a signal, which is not obtained from sound existing near the user, is not a major task of the hearing device. The latter could, e.g., be the task of a mobile phone, which provides the mobile phone user with a sound signal obtained from an electrical signal received via a cellular network, and which electrical signal is obtained from an acoustical signal generated in a remote place, e.g., speech from a person far away.

In another typical embodiment, the hearing device is operatable in a maintenance mode, in which said incoming acoustical sound is received by said input transducer and converted into said audio-representing signals; and said audio-representing signals obtained from said incoming acoustical sound, which can be processed or not-processed audio-representing signals, are transmitted by said transmitter to said long-range communication network.

In other words, in the maintenance mode, sound (sound waves) picked up by the input transducer of the hearing device system and converted into an electrical signal (and possibly processed) is transmitted by the transmitter. Thus, a representation of the acoustical environment surrounding the user and/or a representation of an audio-representing signal perceived by the user can be shared, e.g., with a hearing device support provider.

It is well possible to combine the above-described two typical embodiments. In that case, it is possible to switch (e.g., the user and/or said hearing device support provider may switch) between the normal operation mode and the maintenance mode. It is possible that, also in the maintenance mode, said processed audio-representing signals are converted in said output transducer into said signals to be perceived by said user of the hearing device.

Usually, in the maintenance mode and also in the normal operation mode, said input transmitter is located (worn) in or near the user's ear. Said input transducer of a typical hearing device or hearing device system is located at the user's head in such a way, that the reception of incoming sound in the hearing device (system) is as similar as possible to the reception of incoming sound in the user's ear. It is usually not a main purpose of the input converter to receive sound of the user's voice.

The term maintenance is meant to comprise, e.g., surveillance, repair, fitting, hearing parameter fine-tuning, support, trouble-shooting, problem solving and the like. Said maintenance mode may, accordingly, be considered a repair mode, a fitting mode, a hearing parameter fine-tuning mode, a support mode, a problem solving mode and the like.

The invention can be particularly valuable in connection with hearing device fitting and hearing parameter fine-tuning. Hearing device fitting substantially means adapting the hearing device to a users needs and preferences. When, e.g., a hearing device user is, when he is located in a specific acoustical environment (e.g., in his noisy working place), not content with the performance of his hearing device, he can, while being in said specific acoustical environment, contact a hearing device support provider (e.g., his hearing device fitter) and transmit to his hearing device support provider audio-representing signals obtained from acoustical sound of said specific acoustical environment. This is preferable over an alternative approach, according to which the user would try to explain to the support provider in words what the acoustical environment is like.

The hearing device support provider can, e.g., analyze the transmitted audio-representing signals and/or listen to acoustical sound obtained from the transmitted audio-representing signals (via a transducer, e.g., a loudspeaker) and thereupon generate new hearing device program parameters, which he can send to the user, e.g., using said long-range communication connection, and which allow for an improved hearing sensation for the user in said specific acoustic environment.

In one embodiment, it is foreseen to transmit, in the maintenance mode, hearing-device-related data (e.g., said hearing device program parameters) by said transmitter to said long-range communication network. In the above-described fitting example, the user could transmit, besides said audio-related signals, the hearing device program parameters of a currently used hearing program, and his hearing device support provider can amend and optimize the hearing device program parameters.

Said hearing-device-related data can be, e.g., make of the hearing device, model of the hearing device, serial number, current hearing device system status, hearing device program parameters, and logged data (logging data), wherein logged data are data of any kind, which are logged by the hearing device. Logged data may comprise, e.g., information which is in EP 1 414 271 A2 described to be recorded (logged) in the hearing device, and, e.g., information on how often and in which situation a volume setting has been changed, which program settings have been automatically selected by the hearing device and how often, when and how often has acoustic feedback occurred, and service information, e.g., when a wind and weather protection has to be changed, and problem reports, e.g., when has an attempt to establish a connection failed, and the like. Logged data may also comprise, data, which describe past manipulations the user did to the hearing device system.

Said current hearing device system status may, e.g., comprise, as far as applicable, the currently selected hearing program, the currently selected gain (volume), the current status of features like beamformer, feedback canceller, noise canceller, the classification of the current acoustic environment as determined by the hearing device, the status of a hearing device's battery, the status of different parts of hearing device system like remote control, communication link and the like.

Typically, the whole hearing device system or at least the at least one hearing device is to be worn in or near an ear of the hearing device user. The part worn in or near an ear of the hearing device user (which can be identical with the hearing device itself), can comprise at least one of said input transducer, said output transducer, and said signal processor. Usually, it will comprise two of them or rather all three. Also said transmitter may be comprised in that part of the hearing device worn in or near an ear of the hearing device user.

It is also possible that the hearing device system comprises a mobile communication device, which comprises said transmitter. That mobile communication device is functionally connectable to said part to be worn in or near an ear of said user. Said mobile communication device may be, e.g., a mobile phone, a remote control or the like. Said functional connection may be or comprise a short-range communication network, e.g., via Bluetooth, IrDA, induction, RF, FM or the like.

The hearing device system may comprise one hearing device for each of the user's ears, typically with at least one input transducer each. In that case, two transmitters may be foreseen in the hearing device (one for signals received near each ear). It is also possible to use a single transmitter for transmitting signals obtained from incoming sound received by each of the at least two input transducers sound, e.g., by sending signals from the hearing device worn near a first ear to the hearing device worn near the second ear and sending both signals from there.

A hearing device maintenance system according to the invention comprises at least one hearing device system according to the invention. It typically furthermore comprises

- a receiver for receiving said audio-representing signals which are transmitted by said transmitter; and
- a long-range communication network functionally connected to said transmitter and said receiver.

Said receiver may be comprised in a (mobile) communication device.

Typically, said receiver is located remote from the hearing device. At least, it may be located remote from the hearing device.

According to the invention, the method for maintaining a hearing device system comprising at least one hearing device comprises the steps of

- receiving in the hearing device an incoming acoustical sound;
- converting in the hearing device said incoming acoustical sound into audio-representing signals; and
- transmitting said audio-representing signals from the hearing device system to a long-range communication network.

The step of converting in the hearing device said incoming acoustical sound into audio-representing signals may, of course, comprise further signal processing.

In one embodiment, the method comprises the step of transmitting said audio-representing signals from the hearing device system to a hearing device support provider via a long-range communication connection comprising said long-range communication network.

In another embodiment, the method comprises the step of receiving support from said hearing device support provider in reaction to said transmission of said audio-representing signals. This reception of support may include, e.g., a telephone call, a personal meeting, some conversation, the reception of data. Said communication connection may be a bidirectional connection. In one embodiment, the method comprises the step of receiving said support via said long-range communication connection.

The method may comprise the step of transmitting hearing-device-related data to said long-range communication network.

In one embodiment, the method comprises the step of establishing said long-range communication connection upon a request by said support provider. Although typically, firstly the user will contact the support provider, the user does not necessarily have to take further actions like for establishing (initiating) said long-range communication connection. This can be done by the support provider.

Said support received by the user may comprise, e.g., information, speech, advice, data, new (or amended) parameters, new (or amended) program settings and others.

Said transmission of said audio-related signals from the hearing device system to a receiver (e.g., belonging to a support provider) means, that a transmission takes place by means of at least said transmitter or using at least said transmitter. As indicated above, also further communication connections and/or communication networks, e.g., short-ranged ones, may be comprised.

Said transmission is usually meant to take place from the location, in which said incoming acoustical signals are received. Typically, said transmission takes place "on-line", immediately, without appreciable delay or at least without a willingly added delay. Typically, audio-related signals are sent while incoming acoustical sound (to be converted into audio-related signals to be transmitted) is received.

The method for maintaining a hearing device system may also be considered, e.g., as a method for surveilling and/or repairing and/or fitting and/or fine-tuning and/or supporting a hearing device or hearing device system, or the like.

The advantages of the methods correspond to the advantages of corresponding apparatuses.

Further preferred embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. Generally, alike or alike-functioning parts are given the same reference symbols. The described embodiments are meant as examples and shall not confine the invention.

DETAILED DESCRIPTION OF THE INVENTION

Figure 1:
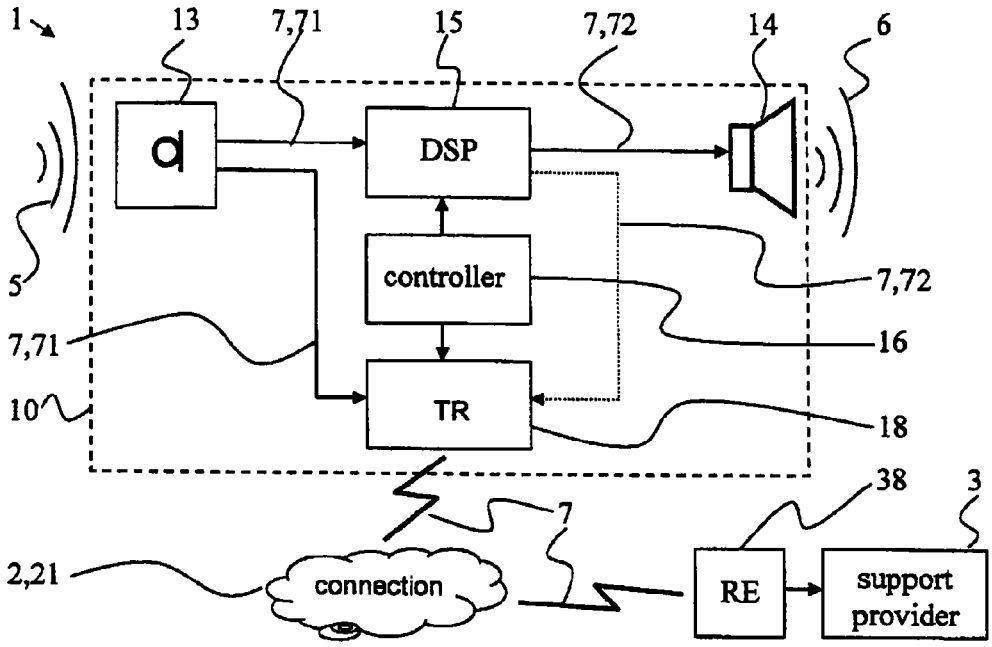
FIG. 1 a schematic diagram of a hearing device maintenance system.

FIG. 1 shows a a schematic diagram of a hearing device maintenance system 1. The hearing device maintenance system 1 comprises a hearing device system 10, a communication connection 2 functionally connected to the hearing device system 10, and a receiver 3, which is also functionally connected to the communication connection 2.

The hearing device system 10 comprises an input transducer 13, e.g., a microphone, a signal processor 15, e.g., a digital signal processor (DSP), an output transducer 14, e.g., a loudspeaker, and a transmitter (TR) 18. It may also comprise a controller 16, embodied in hardware and/or in software. The controller controls the way of functioning of various parts of the hearing device system 10, in particular of the DSP 15 and the transducer 18.

In a normal operation mode, the hearing device system 10 receives incoming sound 5 (sound waves) in the input transducer 13, which converts the incoming acoustical sound 5 into audio-representing signals 7, which are electrical signals. In the DSP 15, the audio-representing signals 7 are processed, e.g., filtered, frequency-dependendly amplified, compressed, so as to form processed audio-representing signals 72, and, possibly after (further) amplification fed to the output transducer 14. The not-processed audio-representing signals are referred to as 71. In the output transducer 14, the processed audio-representing signals 72 are converted into signals 6 to be perceived by a user of the hearing device system 10. This can, e.g., be outgoing sound (sound waves) or electrical signals adapted to stimulate nerves.

Depending on the hearing needs and preferences of said user, the DSP 15 may be programmed with various hearing programs or at least with a number of hearing device parameters, so that a hearing sensation adequate for the user is achieved.

In a maintenance mode, the transducer 18 is provided with audio-representing signals 7, which can be processed audio-representing signals 72 and/or not-processed audio-representing signals 71, and transmits them to a communication network 2, in particular to a long-range communication network 21. Said audio-representing signals 7 are transmitted via communication connection 2, in particular long-range communication connection 21, to a receiver 38 and to a support provider 3.

Figure 2:
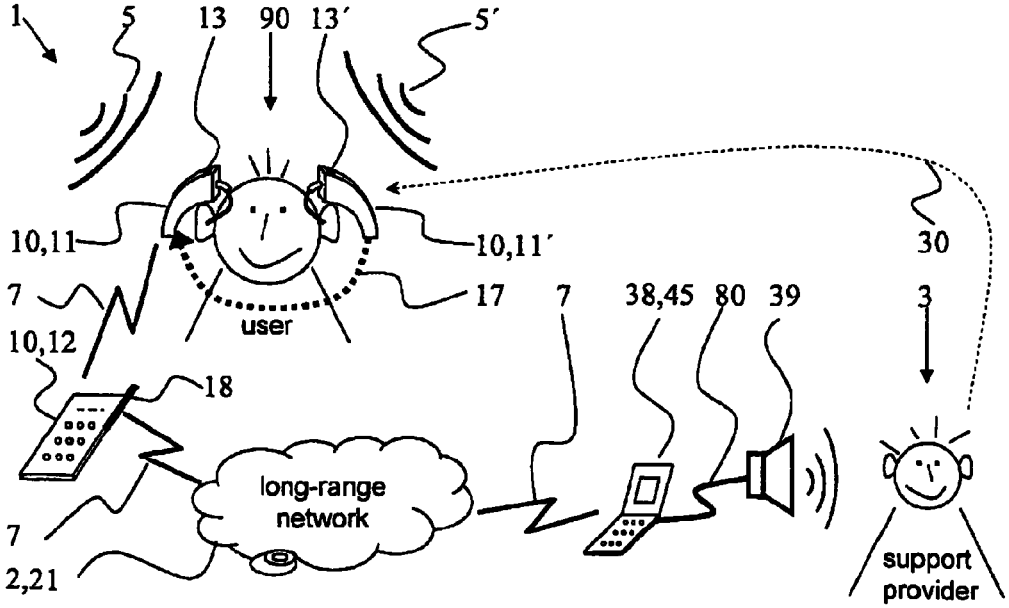
FIG. 2 a schematic illustration of a hearing device maintenance system.
Figure 5:
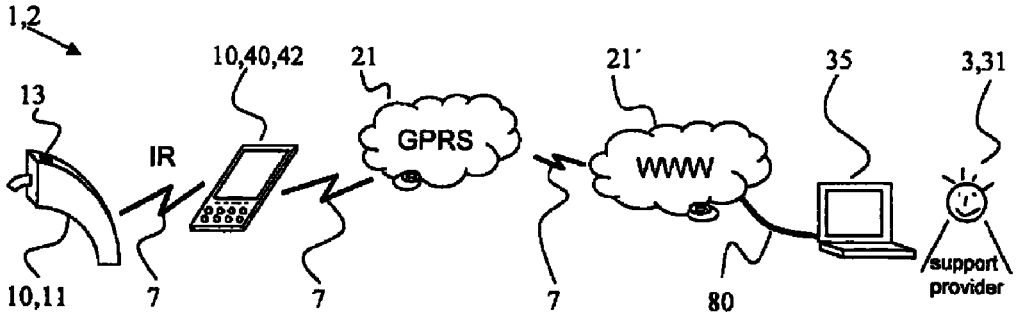
FIG. 5 a schematic illustration of a hearing device maintenance system and a corresponding communication connection.

Said hearing device support provider may be or comprise an individual (see, e.g., FIGS. 2 and 5). Said individual can be a person associated with a manufacturer of said hearing device, e.g., a person of the support or trouble-shooting department of the hearing device manufacturer. Said individual can be associated with a hearing device seller. The person may be a hearing device fitter. The individual may be a hearing device specialist, an audiologoist or another person trained or knowledgeable in the respective hearing devices.

In another embodiment (see, e.g., FIG. 4), said hearing device support provider comprises a computer with a support software. That computer may be located and/or owned and/or maintained by the hearing device manufacturer or by the hearing device seller or another above-named individual.

In another embodiment, the hearing device 10 comprises, in addition, a receiver, and the support provider 3 may transmit signals, data or the like to that receiver via the communication connection 2 (or another communication connection) using a transmitter. This is a way how the user may receive support from the support provider 3.

FIG. 2 shows another view of a hearing device maintenance system 1. The hearing device maintenance system 1 of the schematic illustration of FIG. 2 comprises a hearing device system 10, which comprises two hearing devices 11,11', which are each worn near an ear of the user 90 of the hearing device system 10, and a remote control 12. Each hearing device 11,11' comprises at least one input transducer 13,13' for converting incoming sound 5,5'.

In maintenance mode, audio-representing signals 7 are transmitted from hearing device 11 to the remote control 12. The remote control 12 comprises a transmitter 18 for transmitting said audio-representing signals 7 to long-range communication network 2. Audio-representing signals 7 picked-up in hearing device 11' can be transmitted to hearing device 11 via a connection 17, which may be wireless or wire-bound (indicated as a dashed line in FIG. 2). It is also possible to transmit the audio-representing signals 7 picked-up in hearing device 11' directly to the remote control 7.

The short-range connection to the remote control 12 is wireless, e.g., according to the Infrared Data Associate Protocol (IdDA), but could also be wire-bound.

The audio-representing signals 7 are received by a mobile phone 45 belonging to support provider 3, and which, accordingly, functions as a receiver 38 for said audio-representing signals 7 from long-range communication network 21. Since the audio quality of sound produced by mobile phones is usually not very good, a transducer 39 (loudspeaker, hifi audio system or the like) is connected, e.g., via a wire-bound connection 80, to the mobile phone 45.

Thus, the hearing device support provider 3 can perceive signals, which represent (or at least stem from) the acoustical environment, in which the user 90 is located, while the hearing device support provider 3 himself is located far distant from the user 90 and said acoustical environment. In FIG. 2, the support provider 3 is embodied as an individual 31, but it might be embodied as a computer system (see e.g., FIG. 4). Depending on the problem, which the user 90 might have and for which he contacts the support provider 3, the support provider 3 will analyze what has been picked-up by one or both of input transducers 13,13', in processed or not-processed form.

Thereupon, the support provider 3 can provide support 30 (indicated as thin dashed line) to the user. The support 30 may be or comprise, e.g., a new set of hearing device parameters, by means of which the hearing sensation of the user 90 in his current acoustical environment is improved, or other data, as well as audio signals. The support 30 may be provided while the user is in said acoustical environment, e.g., it can be provided online via the long-range communication connection 2 connecting the support provider 3 and the user 90 (this, of course also applies to other embodiments, e.g., the one of FIG. 1). It is also possible that the support 30 is provided later to the user 90, e.g., upon a coming-up meeting of user 90 and support provider 3.

It can be advantageous to provide the support provider 3 with both, processed 72 and not-processed 71 audio-representing signals. This enables the support provider 3 to compare, what has been picked up by input transducer(s) 13,13', and should help to understand, why the processed signals 72 do not yet provide the desired hearing sensation at the user 90.

And it can be advantageous to provide the support provider 3 with additional information or data, like hearing device parameters, in particular with parameters currently employed in the hearing device 10. This should enable the support provider 3 to understand, why the user 90 is not content with his hearing device's performance and amend said hearing device parameters to improve the hearing device's performance.

Figure 3:
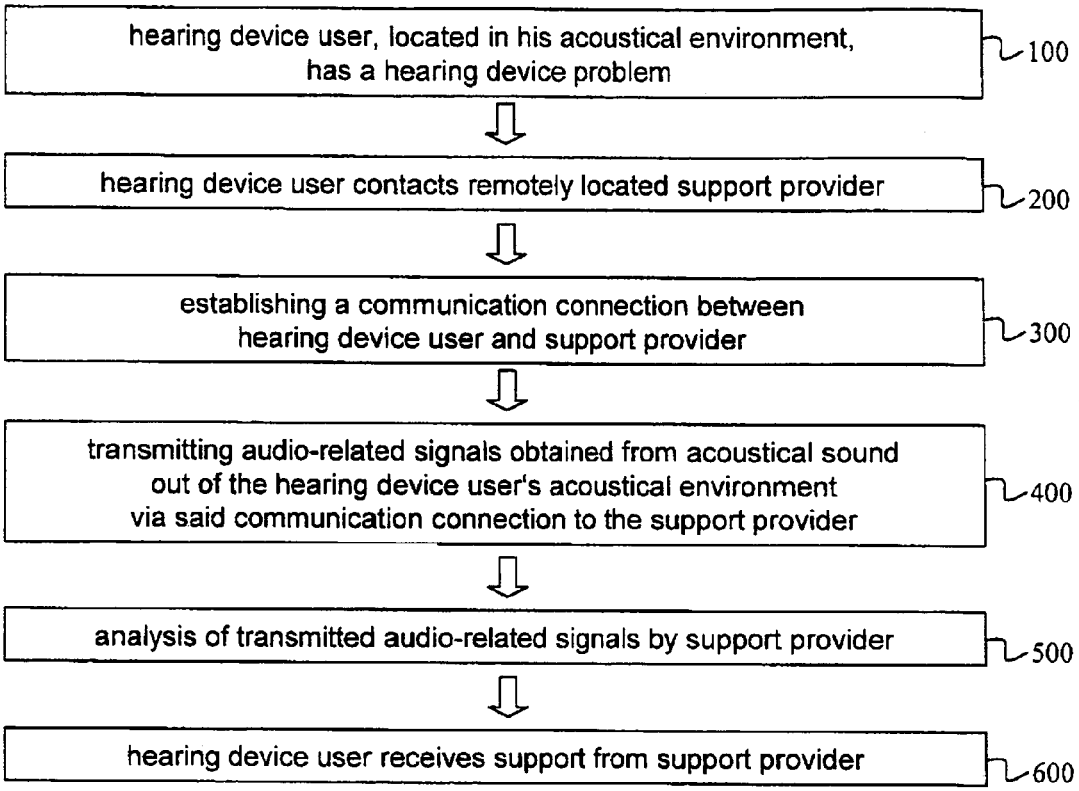
FIG. 3 a block diagram of a method for maintaining a hearing device system.

FIG. 3 shows a block diagram of a method for maintaining a hearing device system comprising at least one hearing device. In step 100, the hearing device user, located in his acoustical environment, encounters a hearing device problem. A possible problem could for example be that the understandability of speech is not satisfying to the user. This may be caused by not-optimally adjusted hearing device parameters or by some malfunction, e.g., of a signal processor or of a transducer.

In step 200, the hearing device user contacts the remotely located support provider. This may take place via a communication connection between the hearing device user and the support provider established in step 300 (by the support provider or by the hearing device user), or via some other communication connection. E.g., the user informs the support provider that he has a problem or inconvenience, and how that problem or inconvenience manifests. Then the support provider (or the user) takes action to establish the communication connection for transmitting audio-representing signal.

In step 400, audio-related signals obtained from acoustical sound out of the hearing device user's acoustical environment is transmitted to the support provider via said communication connection established between the hearing device user and the support provider.

In step 500, the transmitted audio-related signals are analyzed by the support provider. In step 600, the hearing device user receives support from the support provider.

The communication connection between the user and the support provider can be embodied in various ways; and a possible communication within different parts of the hearing device can be embodied in various ways. Examples follow below.

With a support provider being located remote from the user, the communication connection between the two will practically always involve a long-range communication connection and/or a long-range communication network.

Figure 4:
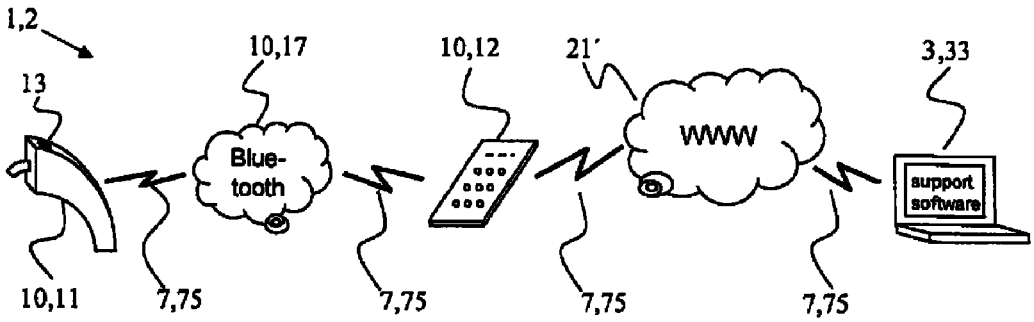
FIG. 4 a schematic illustration of a hearing device maintenance system and a corresponding communication connection.

FIG. 4 shows a schematic illustration of a hearing device maintenance system 1 and a corresponding communication connection 2. The hearing device system 10 comprises a remote control 12, with which it communicates wirelessly via a short-range communication network 17 according to the Bluetooth protocol. The hearing device's transmitter is comprised in the remote control and transmits audio-representing signals 7 and hearing-device-related data 75 to the Internet 21' (www). To the internet 21' connected is also a computer 33, which functions as a support provider 3. The computer 33 may comprise speech guidance, so as to ease the communication between the user and the computer 33. It is also possible that the computer 33 merely stores or forwards the audio-representing signals 7 for further analysis (e.g., by an individual).

FIG. 5 shows a schematic illustration of another hearing device maintenance system 1 and a corresponding communication connection 2. The transmitter of the hearing device system 10 is in this case comprised in a (mobile) communication device 40, in this case a personal digital assistant 42 (PDA), which is part of the hearing device system 10. The PDA 42 is functionally connected to a GPRS communication network (General Packet Radio Service network), via which the Internet 21' is accessed. To the internet 21' connected (e.g., as indicated through a wire-bound connection 80) is also a computer 35 belonging to the hearing device support provider 3. An individual 31 associated with the hearing device seller or associated with the hearing device manufacturer, e.g. an employee of the service department of the hearing device manufacturer, can receive information sent via the described communication connection 2 through said computer 35, e.g., as an e-mail.

Said communication connections 2 usually comprise at least one long-range communication connection. That long-range communication connection may involve a long-range communication network. The long-range communication connection may be wireless or wire-bound. It may, e.g., involve the Global System for Mobile Communications (GSM), the Universal Mobile Communications System (UMTS), the General Packet Radio Service (GPRS), the Enhanced Data Rate for GSM Evolution (EDGE) or Cellular Digital Packet Data (CDPD) or the like. It may involve the short message system (SMS) and/or e-mails, hypertext transfer protocol (HTTP) messages and Transmission Control Protocol/Internet Protocol messages (TCP/IP). A communication connection 2 may (also) comprise a short-range communication connection. Within the hearing device, i.e., between various parts of the hearing device, there may be wireless and/or wire-bound communication connections, in particular, short-range communication connections.

Short-range communication connections may comprise at least one short-range communication network. They may comprise a radio communication network like, e.g., Digital Enhanced Cordless Telephony (DECT), Wireless Local area networks (WLAN), Bluetooth, or an optical communications network, like, e.g., according to the Infrared Data Associate Protocol (IdDA), or the like.

LIST OF REFERENCE SYMBOLS

1 hearing device maintenance system
10 hearing device system
11,11' hearing device, part of hearing device worn in or near the user's ear
12 remote control
13,13' input transducer, microphone
14 output transducer, loudspeaker
15 signal processor, digital signal processor, DSP
16 controller
17 short-range communication connection (wireless or wire-bound); short-range communication network
18 transmitter, sender; wireless transmitter
2 communication connection, communication network
21 long-range communication connection, long-range communication network
21' long-range communication connection, long-range communication network, internet (www)
22 short-range communication connection, short-range communication network
3 hearing device support provider
30 support
31 individual, hearing device seller, hearing device specialist, hearing device fitter, audiologist, hearing device manufacturer, individual associated with hearing device manufacturer
33 computer with maintenance/support software
35 computer, personal computer
38 receiver
39 transducer, loudspeaker
40 communication device
42 personal digital assistant
45 mobile phone
5,5' incoming acoustical sound
6 signals to be perceived by user
7 audio-representing signals
71 not-processed audio-representing signals
72 processed audio-representing signals
75 hearing-device-related data
80 wire-bound connection
90 user, hearing device user
100,200,300,400,500,600 steps
RE receiver
TR transmitter

The invention claimed is:

1. Hearing device system comprising at least one hearing device, said system comprising:

an input transducer for receiving incoming acoustical sound existing in an environment in which a user of said hearing device currently is and converting said incoming acoustical sound into audio-representing signals to be processed into processed audio representing signals by a signal processor;

an output transducer for converting the processed audio-representing signals into signals to be perceived by said user of the hearing device; and a transmitter structured and configured for transmitting one or both of the audio-representing signals to be processed and the processed audio representing signals to a long-range communication network, wherein a receiver over said long-range communication network receives said one or both of the audio-representing signals to be processed and the processed audio representing signals transmitted by said transmitter.

2. System according to claim 1, which is operatable in a normal operation mode, in which said incoming acoustical sound is received by said input transducer and converted into said audio-representing signals to be processed;

said audio-representing signals to be processed obtained from said incoming acoustical sound are processed in said signal processor, thus generating said processed audio-representing signals; and said processed audio-representing signals are converted in said output transducer into said signals to be perceived by said user of the hearing device.

3. Hearing device system comprising at least one hearing device, said system comprising:

an input transducer for receiving incoming acoustical sound existing in an environment in which a user of said hearing device currently is and converting said incoming acoustical sound into audio-representing signals to be processed into processed audio representing signals by a signal processor;

an output transducer for converting the processed audio-representing signals into signals to be perceived by said user of the hearing device;

a transmitter structured and configured for transmitting one or both of the audio-representing signals to be processed and the processed audio representing signals to a long-range communication network, wherein a receiver over said long-range communication network receives said one or both of the audio-representing signals to be processed and the processed audio representing signals transmitted by said transmitter;

wherein the hearing device system is operable in a maintenance mode, in which incoming acoustical sound is received by said input transducer and converted into the audio-representing signals to be processed; and said one or both of the audio-representing signals to be processed and the processed audio representing signals in said maintenance mode are transmitted by said transmitter to said long-range communication network.

4. System according to claim 3, wherein, in the maintenance mode, hearing-device-related data are transmitted by said transmitter to said long-range communication network.

5. System according to claim 4, wherein said hearing-device-related data comprise at least one selected from the group consisting of make of the hearing device, model of the hearing device, serial number, current hearing device system status, hearing device program parameters, and logged data.

6. System according to claim 1, wherein said at least one hearing device is to be worn in or near an ear of said user.

7. System according to claim 1, wherein said at least one hearing device comprises at least one selected from the group consisting of said input transducer, said output transducer, and said signal processor.

8. System according to claim 1, comprising a mobile communication device comprising said transmitter and being functionally connected to said at least one hearing device.

9. System according to claim 8, wherein said functional connection is or comprises a short-range communication network.

10. Hearing device maintenance system comprising:

a hearing device system according to claim 1;

a receiver for receiving said one or both of the audio-representing signals to be processed and the processed audio representing signals which are transmitted by said transmitter; and a long-range communication network functionally connected to said transmitter and said receiver.

11. System according to claim 10, wherein said receiver is located remote from the hearing device.

12. Method for maintaining a hearing device system comprising at least one hearing device, said method comprising the steps of:

receiving in the hearing device an incoming acoustical sound existing in an environment in which a user of said hearing device currently is;

converting in the hearing device said incoming acoustical sound into audio-representing signals to be processed into processed audio representing signals by a signal processor;

converting in the hearing device the processed audio representing signals into audible signals; and transmitting one or both of the audio-representing signals to be processed and the processed audio representing signals from the hearing device system to a long-range communication network.

13. Method according to claim 12, comprising the step of transmitting said one or both of the audio-representing signals to be processed and the processed audio representing signals from the hearing device system to a hearing device support provider via a long-range communication connection comprising said long-range communication network.

14. Method according to claim 13, comprising the step of receiving support from said hearing device support provider in reaction to said transmission.

15. Method according to claim 14, comprising the step of receiving said support via said long-range communication connection.

16. Method according to claim 12, comprising the step of transmitting hearing-device-related data to said long-range communication network.

17. Method according to claim 13, comprising the steps of:

establishing said long-range communication connection upon a request by said support provider; and receiving support from said hearing device support provider in reaction to said transmission.

18. System according to claim 1, wherein said processed audio-representing signals are transmitted by said transmitter.

19. System according to claim 1, wherein said audio-representing signals to be processed are transmitted by said transmitter.

20. System according to claim 1, wherein said at least one hearing device comprises said input transducer.

21. Method according to claim 12, wherein said at least one hearing device comprises an input transducer.

* * * * *